United States Patent [19]

Hill

[11] 4,427,037

[45] Jan. 24, 1984

[54] SHUTTLELESS LOOMS

[75] Inventor: Ashley Hill, Belfast, Ireland

[73] Assignee: James Mackie & Sons Ltd., Belfast, Ireland

[21] Appl. No.: 312,353

[22] Filed: Oct. 16, 1981

[51] Int. Cl.[3] ..... D03D 47/00

[52] U.S. Cl. ..... 139/449

[58] Field of Search ..... 139/449

[56] References Cited

U.S. PATENT DOCUMENTS

| | | | |
|---|---|---|---|
| 3,232,320 | 2/1966 | Eilhauer | 139/449 |
| 3,391,714 | 7/1968 | Quintana | 139/449 |
| 4,338,974 | 7/1982 | Mizzini | 139/449 |

*Primary Examiner*—Henry Jaudon

*Attorney, Agent, or Firm*—Wood, Herron & Evans

[57] ABSTRACT

The invention relates to shuttleless looms in which weft is carried through the warp shed by means of at least one weft carrier which is reciprocated into and out from the shed to cause the weft to be carried through the shed. In order to vary the speed of the weft carrier during its passage through the warp shed, a mechanism is provided including both a drive member connected to the weft carrier and a guide member, the drive member being connected to a reciprocating drive which also engages the guide member, the arrangement being such that during each loom cycle the guide member acts to cause the point of connection of the drive to the drive member to be altered so as to vary the speed of the drive transmitted to the weft carrier.

51 Claims, 7 Drawing Figures

SHUTTLELESS LOOMS

This invention relates to shuttleless looms, i.e. looms in which the weft thread, yarn or tape is carried through the warp shed by means of at least one weft carrier, e.g. a spear or rapier which is reciprocated into and out from the shed to cause the weft to be carried through the shed.

Either one weft carrier can be used which picks up the weft at one side of the shed and carries it completely through the shed or alternatively, the shuttleless loom may be of the weft transfer type in which the weft thread is carried through the shed by means of two weft carriers each being reciprocated into and out from the shed from opposite sides of the loom respectively, one weft carrier gripping the weft thread to carry this into the shed, the weft being transferred at the centre of the shed to the other carrier, which is then driven to carry the weft outwardly through the remainder of the shed.

It is desirable for the speed of the weft carrier or carriers to vary during its passage through the warp shed so that the speed of the, or each, carrier is at its slowest in the region of the edge of the shed where the weft thread has to be picked up and subsequently released and, when the loom is of the weft transfer type, in the region of the centre of the shed where the weft thread has to be transferred from one carrier to the other. Conversely, with the latter type, the carriers should be travelling at their maximum speed at a point approximately halfway between the edge of the warp shed and centre of the shed enabling the loom to work at high speed.

A shuttleless loom in accordance with the invention has a weft carrier drive mechanism for reciprocating the, or each, carrier into and out from the shed comprising a rod or the like connected to means to drive it in a reciprocating path and, both to a drive member connected to the weft carrier and to a guide member, the drive member being pivotally or rotatably mounted, the arrangement being such that the rod or the like, drive member and guide member are capable of relative movement one to another during each loom cycle, the guide member acting to cause the distance between the point of pivotal connection of the rod to the drive member and the drive member pivot axis, to vary during each cycle so as to vary the speed of the drive transmitted by the drive mechanism to the weft carrier.

Preferably, the or each, weft carrier is driven by a flexible perforated tape, the perforations of which mesh with the teeth of a drive wheel driven by a shaft carrying a pinion. The pinion in this preferred arrangement is driven by an arcuate drive strip mounted on or forming part of the drive member which may conveniently be in the form of a sector of a circle.

The oscillating or reciprocating drive may be provided by a crank member acting through a connecting rod which is provided with a pivot pin(s), rollers, or friction sliding blocks engaging a slot or raised cam profile in the drive member and in the guide member.

The carrier or carriers are driven at maximum velocity when the connecting rod is moving at its maximum velocity, i.e. when it is positioned midway between the ends of its stroke and the connecting pin is then arranged to be at its nearest position the pivot pin of the drive member. When the connecting rod is moving at its slowest, i.e. at or adjacent each end of its stroke, the connecting pin is arranged to be at its farthest distance from the pivot of the drive member. In this way the desired speed variation for the weft carriers caused by the oscillating or reciprocating movement of the connecting rod is enhanced by the movement of the point of connection of that rod to the drive member caused by the slot in the guide member.

The shape and/or position of the slot in the guide member is preferably variable (or various guide members may be employed) as is the position of the slot relative to the pivot of the drive member. In this way, adjustements to the speed of the carrier at various points during its movement can be made.

The invention will now be further described, by way of example, with reference to the accompanying sketch drawings in which.

Figure 4:
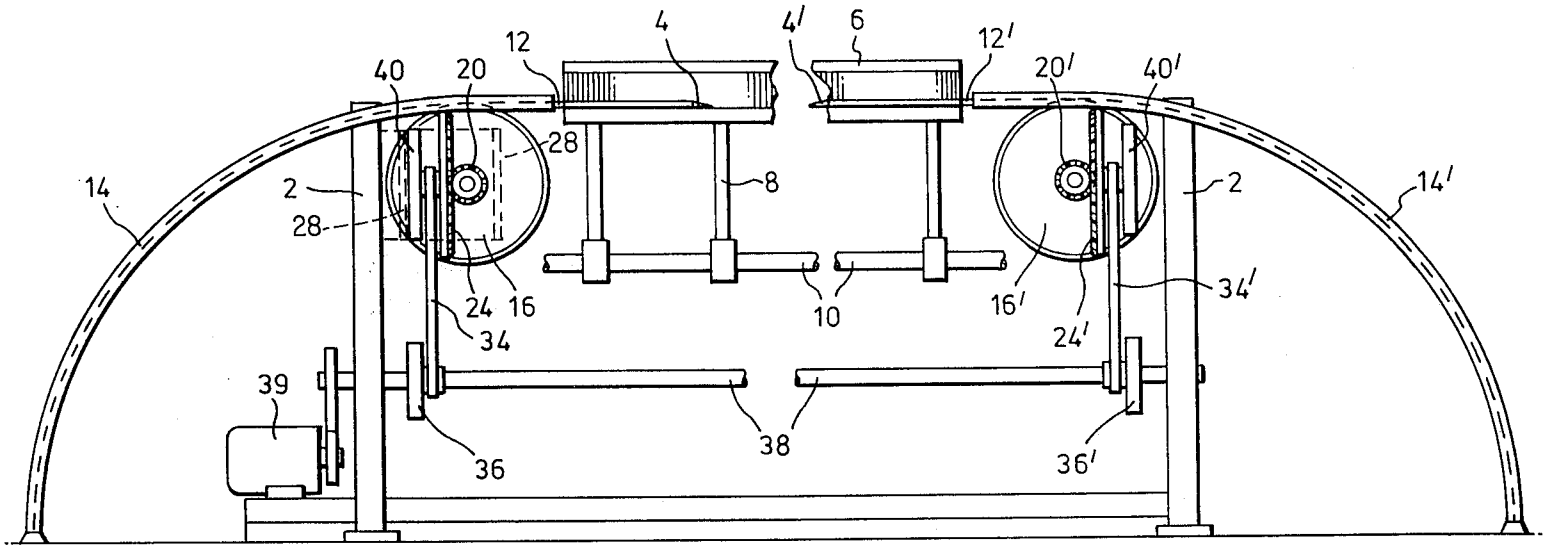
FIG. 4 is a diagram of a front view of a shuttleless loom incorporating the drive mechanism shown in FIGS. 1 and 2.

The loom shown generally in FIG. 4 has a frame 2 and comprises two weft carriers 4, 4', one of which acts to carry the weft thread into the shed and the weft is then transferred at the centre of the shed to the other carrier which, on reversal of the drive, acts to carry the weft out from the shed. The reed 6 and sley 8 is operated by the beat-up shaft 10 with the carriers outside the shed so as to beat-up the weft thread after insertion.

Each carrier 4, is carried by a flexible perforated tape 12 which runs in low friction guides 14. The perforations in the tape engage with teeth of tape driving wheels 16.

The tape drive wheels 16, are reciprocated in opposite directions so that the two weft carriers 4, 4' first of all advance towards each other through the shed and then, on reversal of the movement of the drive wheels, retreat from each other and move out from the shed.

Figure 1:
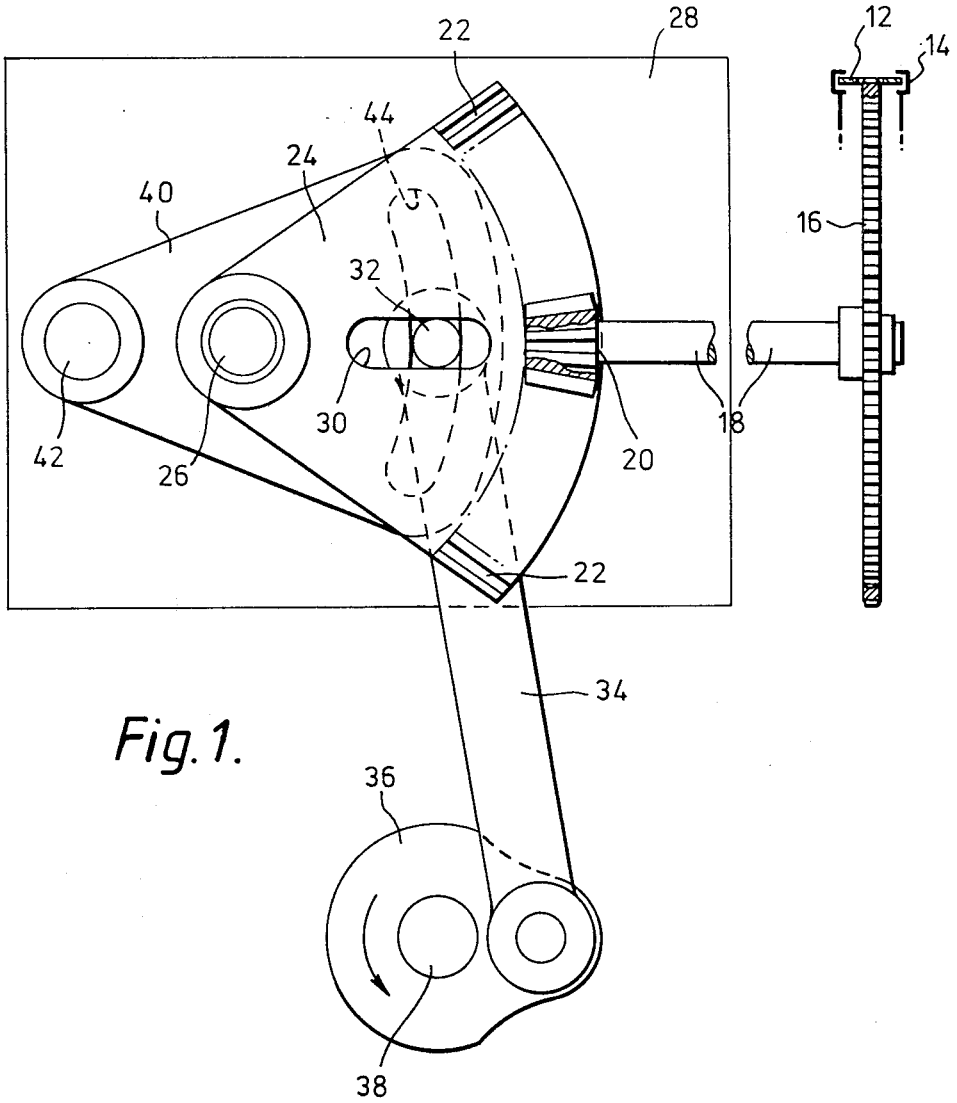
FIG. 1 is a diagram of a drive mechanism of a shuttleless loom of the transfer type in accordance with the invention showing the mechanism in the position in which a carrier is being driven at its maximum velocity.

Referring to FIG. 1, each drive wheel 16 is carried on a shaft 18 carrying a pinion 20 at its inner end which meshes with teeth 22 formed in an arcuate strip provided along the outer end of a quadrant shaped plate drive member 24.

The drive plate 24 is pivoted at 26 to one side plate 28 of a gear box carried by the loom frame 2 but not shown in FIG. 4. The drive plate is provided with a slot 30 which extends radially out from the pivot 26 towards the arcuate outer edge of the plate along a line bisecting the plate. A slidable connector in the form of roller 32, rotatably mounted on a stud 33 at one side of the outer end of a connecting rod 34 engages in the slot 30 so as to transfer to the drive plate 24 the reciprocal drive of a crank member 36 which is pivotally connected to the other end of the connecting rod 34 and which is mounted on the main drive shaft 38 of the loom which is driven, as seen in FIG. 1, in a counter-clockwise direction by a motor 39 (see FIG. 4).

It will be appreciated that as the crank 36 rotates, the connecting rod 34 and hence the drive plate 24 is reciprocated in a vertical plane as shown in the drawings so as to drive the drive wheel 16, through the engagement of the teeth 22 and pinion 20 to reciprocate the weft carriers 4 into and out from the shed.

Figure 5:
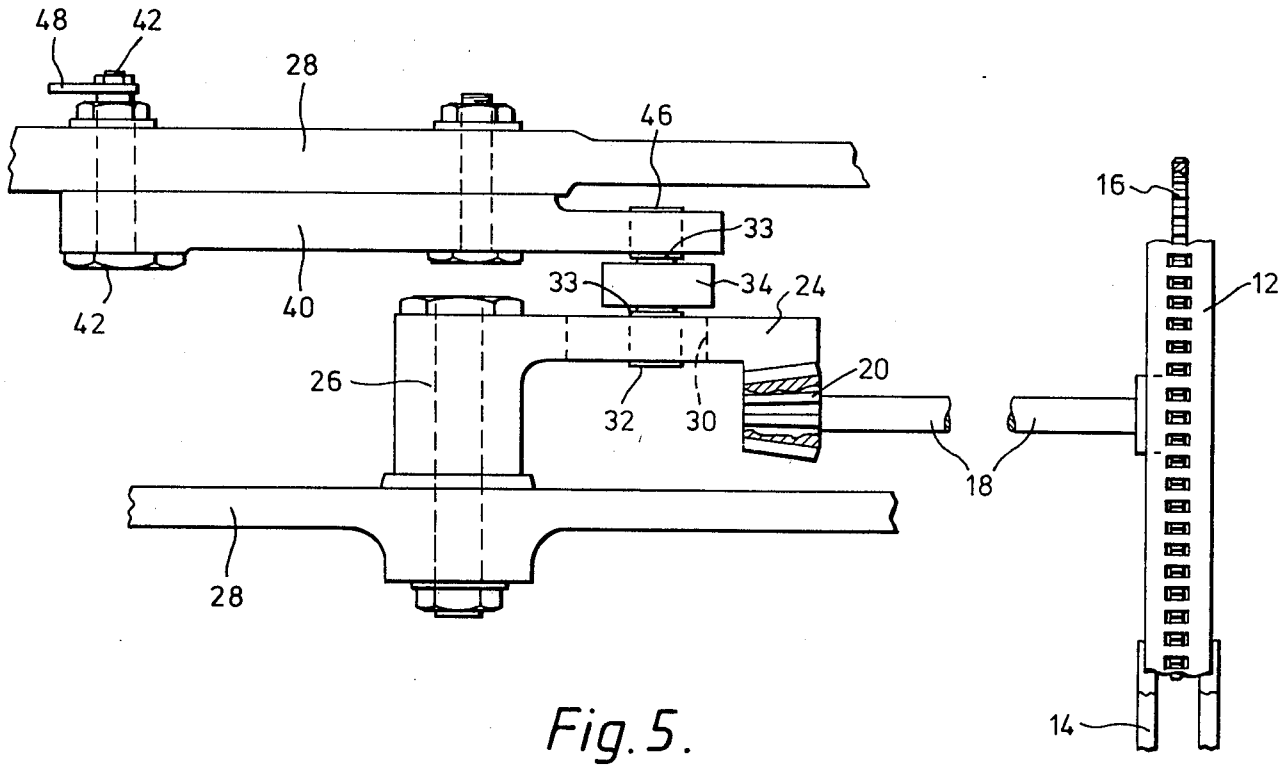
FIG. 5 is a plan view of the drive mechanism of FIG. 1.

A guide member in the form of a guide plate 40 is provided to control the movement of the roller 32 and this guide plate which is adjustably fixed to the loom at a point 42 is provided with a guide plate in the form of an arcuate slot 44 in which a slidable connector in the form of roller 46 rotatably mounted on stud 33 on the other side of the connecting rod from the roller 32, engages (see FIG. 5).

It will be appreciated that the rollers 32, 46 and hence the connecting rod 34 and the drive member 24, can move relative to the guide plate 40 during each cycle of the crank member 36. The slot 44, which is defined by a pair of parallel edges, in the fixed guide plate 40 then acts to move the point of connection of the roller 32 within the slot 30 in the drive plate 24 towards and away from the pivot 26 of the drive member or plate 24 during each reciprocation.

In the position shown in FIG. 1, the connecting rod 34 is moving at its fastest in a vertical direction and the pin 32 is closest to the pivot 26 of the drive plate. This means that the drive plate is moving upwardly at its maximum speed both due to the maximum speed of the connecting rod 34 and the position of the pivot pin 32.

Figure 2:
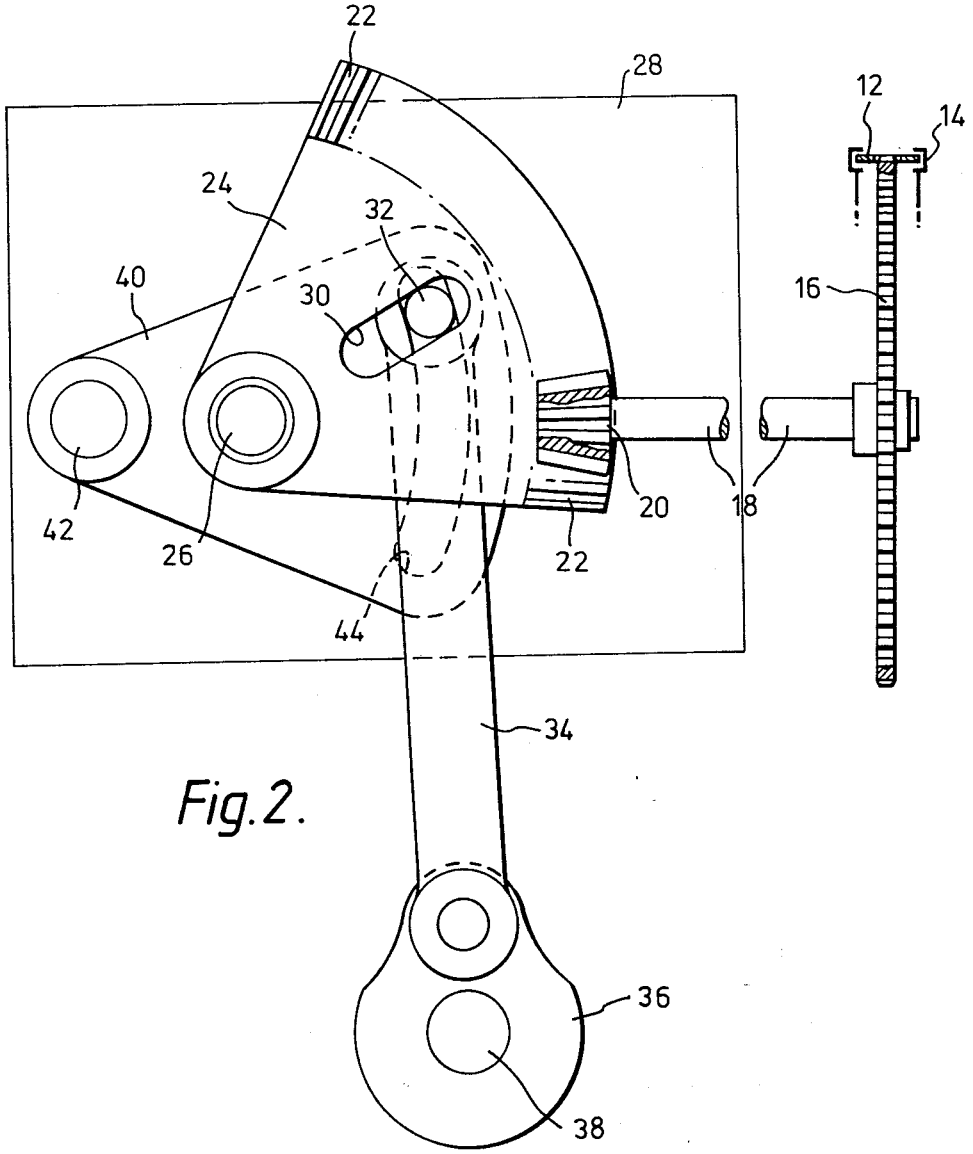
FIG. 2 is a diagram similar to FIG. 1 but showing the position of the mechanism when the carrier is stationery at one end of its stroke.

By the time that the position illustrated in FIG. 2 has been reached in which, momentarily, the connecting rod is stationary, the pivot pin 32 has been moved along the slot 30 due to the engagement of roller 46 in the slot 44 of the guide plate 40, to a position in which it is at its farthest from the pivot 26. This means that just before and just after the top dead centre position has been reached (FIG. 2), the drive plate will be moving at its slowest speed.

Figure 3:
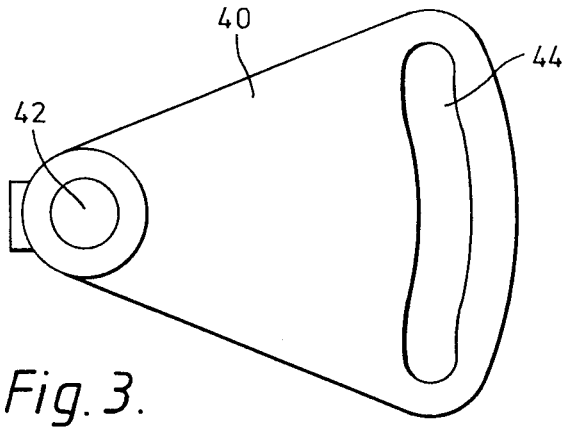
FIG. 3 is a sketch of an alternative form of guide member.

It will be appreciated that the slot 44 of the guide member or plate 40 can have any desired shape to give any desired velocity to the weft carrier at any point during the loom's cycle. An alternative shape for the slot 44 is illustrated in FIG. 3. For example, the velocity at the centre of the stroke can be further increased and by a change of the curvature and direction of the slot, the speed of the carriers at the end of the stroke can be further reduced.

Means will advantageously be provided to alter the position of the guide plate 40 and hence of the slot 44 relative to the pivot point 26 of the drive plate 24. This may be done by adjusting the point of connection of the plate 40 to the fixed shaft 42 which may be eccentric and have a handle 48 (see FIG. 5) attached to it, turning of the handle adjusting the position of the plate.

Alternatively, the guide plate 40 could be attached to a rail or bracket which could be adjustable towards or away from the pivot 26.

It will be appreciated that adjustment of the position of the slot 44 relative to the pivot 26 will alter the length of the stroke of the weft carrier as well as its velocity. If one uses a separate guide plate 40 having merely a slot 44 with a different profile, then the velocity of the weft carrier 4 can be altered without altering the length of the stroke. Each loom may be supplied with a range of interchangeable guide plates each having a different slot profile so as to control the speed of the inserters in accordance with the quality of the yarn.

Figure 6:
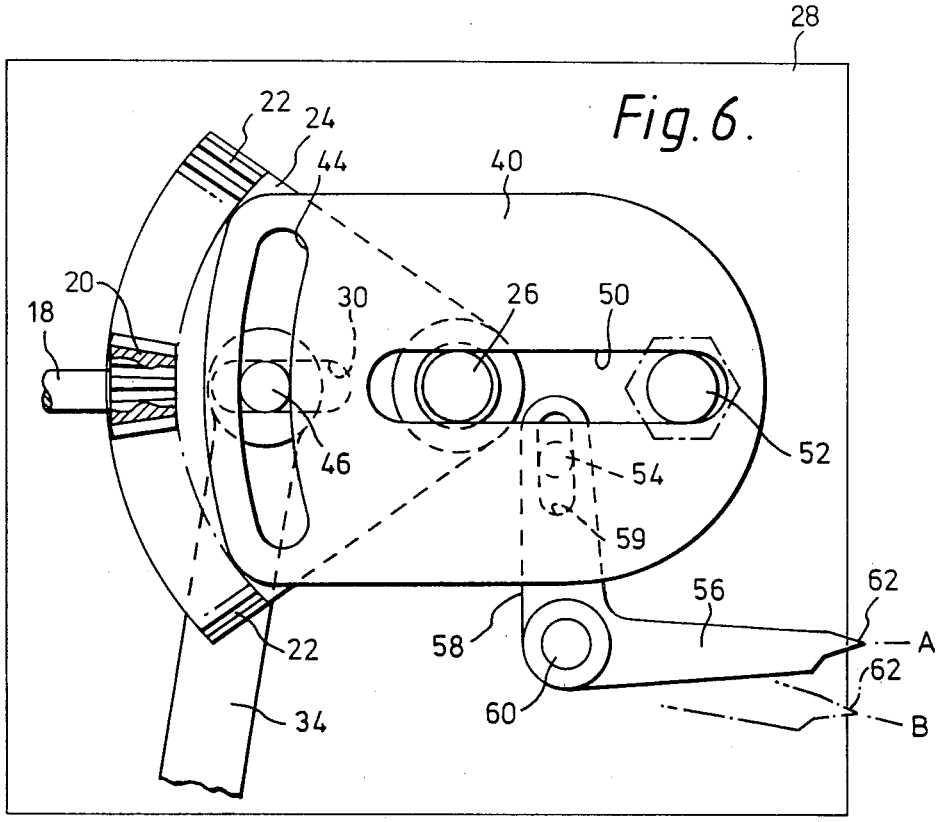
FIG. 6 is a diagram similar to FIG. 1 illustrating an alternative mechanism in accordance with the invention.

FIG. 6 illustrates an alternative form of guide plate 40 from that shown in FIGS. 1 and 2. Instead of the guide plate being secured to a shaft 42 it has a longitudinal slot 50 through which the axle 26 of the plate 24 passes. In this construction the axle 26 will pass right across the gear box. At the side 28 of the gear box to which the guide plate 40 is clamped a special screwed bush (not shown) locates over the shaft and passes through the gear box wall. A locking nut then tightens the collar of the bush against the guide plate 40 so as to clamp it in position. Another locking screw 52 also passes through the slot 50 so as to securely hold the guide plate against the gear box wall and prevent it moving during operation of the loom.

In this case in order to adjust the position of the guide plate 40 relative to the drive plate 24, a pin 54 is fixed to one side of the guide plate. This pin co-operates with an adjusting handle 56 which has an extension 58 with a slot 59 which locates over the pin 54. The handle also has a stud 60 which passes through the wall of the gear box and is freely rotatable in a bush in same. When it is desired to adjust the position of the guide plate, the locking nuts on the screw 52 and shaft 26 are slackened and the handle 56 moved to the desired position thus sliding the plate 40 along the axle 26 and locking screw which can then be retightened. The handle 56 may be shaped as a pointer 62 to align with suitable markings on the outside of the gear box and hence make adjustment of the stroke of the inserters a very simple procedure.

Instead of having a quadrant shaped drive plate 24, the plate could be replaced by a toothed wheel.

Whilst, in the constructions described, the guide plate 40 is fixed, in any one adjusted position this could be modified by driving the shaft 42 to oscillate at a different rate from the oscillation of the drive plate 24 so that there will be a further relative movement of the two. By varying the rate of relative displacement the velocity of the carrier can be further controlled.

Instead of the guide plates being formed with a slot, the slot could be replaced by a guide path in the form of a raised cam profile.

Figure 7:
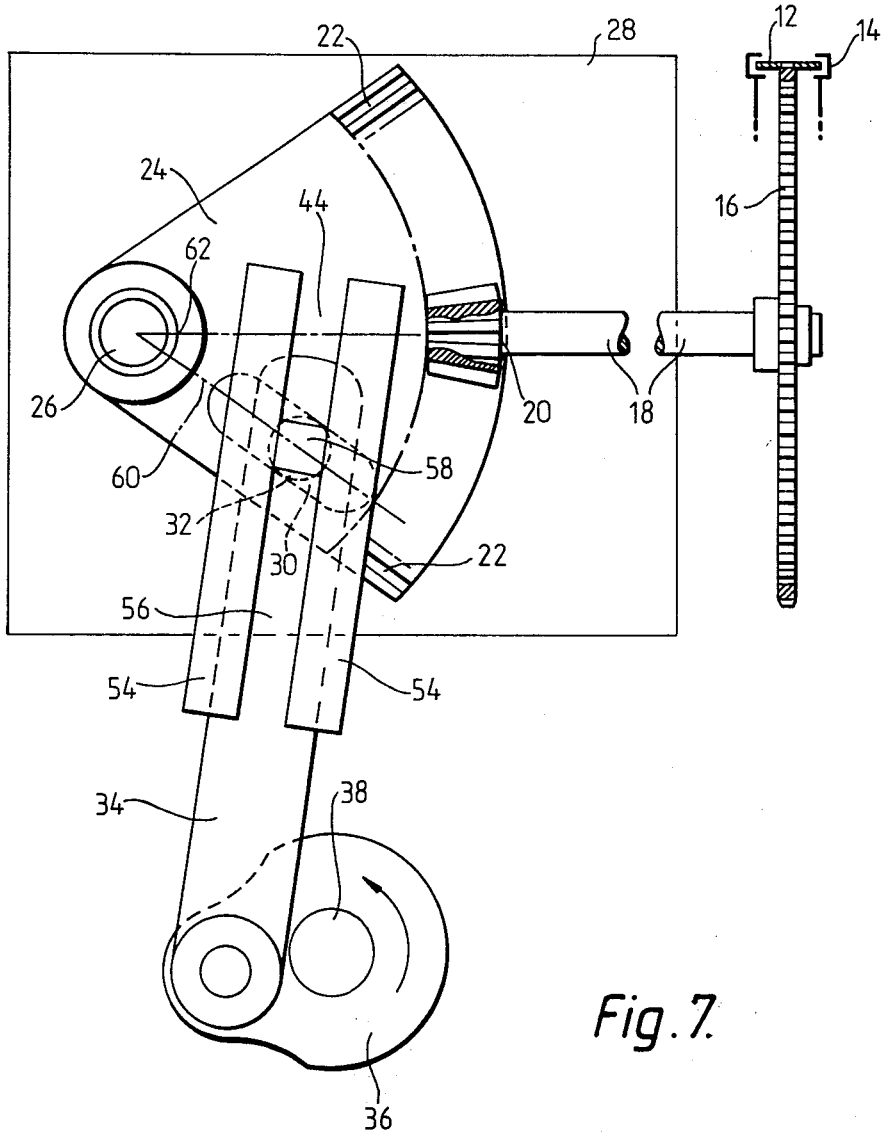
FIG. 7 is a diagram similar to FIG. 1 illustrating a further alternative form of guide member.

FIG. 7 illustrates a further alternative form of guide member comprising two separate straight bars 54, the space 56 between the bars 54 defining the slot 44 in which a slide member 58 rotatably mounted on stud 33 engages. The roller 32 is also rotatably mounted on the stud 33 on the other side of the connecting rod 34, and engages the slot 30. FIG. 7 additionally illustrates an alternative position of the slot 30 in the drive plate 24 wherein the slot lies on a radius 60 from the centre of the axle 26.

I claim:

1. A shuttleless loom comprising a frame, at least one weft carrier supported on said frame, and a drive mechanism supported by said frame to drive said weft carrier, said drive mechanism comprising a connecting rod, means connected to said rod at its driven end to drive said rod in a reciprocating path, a drive member connected to said weft carrier, said drive member being pivotally connected to said frame, and said drive member being pivotally connected to said rod at said rod's non-driven end to pivot said drive member during reciprocation of said rod, and a guide member which defines a guide path, said guide member being slidably connected to said rod at said rod's non-driven end so that said slidable connection follows said guide path during reciprocation of said rod, said rod, drive member and guide member all being movable relative one to another during each loom cycle, and said guide member functioning to vary that distance between the pivot connection of said rod to said drive member and the pivot axis of said drive member relative to said frame during each loom cycle, the speed of the drive transmitted by said drive mechanism to said weft carrier being varied also in response to the variation in said distance.

2. A shuttleless loom as claimed in claim 1, said drive mechanism further comprising adjustment means connected to said guide member, said adjustment means permitting said guide member to be adjustably positioned in a desired fixed location relative to said frame.

3. A shuttleless loom as claimed in claim 1, said drive mechanism comprising a flexible perforated tape connecting said drive member to said weft carrier, the perforations of said tape meshing with the teeth of a drive wheel driven by a drive shaft.

4. A shuttleless loom as claimed in claim 3, said drive mechanism comprising a pinion driven by an arcuate strip mounted on said drive member.

5. A shuttleless loom as claimed in claim 4, said drive member having the general shape of a quadrant of a circle.

6. A shuttleless loom as claimed in claim 1, said connecting rod engaging both said drive member and said guide member, and said means to drive said rod comprising a crank member acting through said connecting rod.

7. A shuttleless loom as claimed in claim 1, said connecting rod comprising a pivot pin mounted on one end thereof, said pivot pin engaging said guide path in said guide member.

8. A shuttleless loom as claimed in claim 1, the position of said guide path in said guide member being adjustable relative to the position of the pivot of said drive member to said frame.

9. A shuttleless loom as claimed in claim 1, said connecting rod comprising a pivot pin mounted on one end thereof, said pivot pin engaging a slot in said drive member.

10. A shuttleless loom as claimed in claim 1, said weft carrier being driven at maximum speed when the connection between said rod and said drive member is at its nearest position to the pivot axis of said drive member to said frame, and said weft carrier moving at minimum speed when the connection between said rod and said drive member is at its furthest distance from the pivot axis of said drive member to said frame.

11. A shuttleless loom as claimed in claim 1, said drive mechanism comprising a handle connected to said guide member, the position of said guide member relative to said drive member being alterable by an operator through use of said handle.

12. A shuttleless loom comprising a frame, at least one weft carrier supported on said frame, and a drive mechanism supported by said frame to drive said weft carrier, said drive mechanism comprising a connecting rod having a slide member attached to one end thereof, means connected to said rod to drive said rod in a reciprocating path, a drive member pivotally connected to both said frame and said rod, said drive member also being connected to said weft carrier, and a guide member comprising a pair of generally parallel edges which cooperate to define a guide slot, said rod's slide member being engaged with said guide slot to connect said rod and said guide member, said guide member also being connected to said drive member, said rod, drive member and guide member all being movable relative one to another during each loom cycle, and said guide member functioning to vary that distance between the pivot connection of said rod to said drive member and the pivot axis of said drive member relative to said frame during each loom cycle, the speed of the drive transmitted by said drive mechanism to said weft carrier being varied also in response to the variation in said distance.

13. A shuttleless loom as claimed in claim 12, said drive mechanism further comprising adjustment means connected to said guide member, said adjustment means permitting said guide member to be adjustably positioned in a desired fixed location relative to said frame.

14. A shuttleless loom as claimed in claim 12, said drive mechanism comprising a flexible perforated tape connecting said drive member to said weft carrier, the perforations of said tape meshing with the teeth of a drive wheel drive by a drive shaft.

15. A shuttleless loom as claimed in claim 14, said drive mechanism comprising a pinion driven by an arcuate strip mounted on said drive member.

16. A shuttleless loom as claimed in claim 15, said drive member having the general shape of a quadrant of a circle.

17. A shuttleless loom as claimed in claim 12, said connecting rod engaging both said drive member and said guide member, and said means to drive said rod comprising a crank member acting through said connecting rod.

18. A shuttleless loom as claimed in claim 12, said connecting rod comprising a pivot pin mounted on one end thereof, said pivot pin engaging a slot defined by said guide member.

19. A shuttleless loom as claimed in claim 12, the position of said slot in said guide member being adjustable relative to the position of the pivot of said drive member to said frame.

20. A shuttleless loom as claimed in claim 12, said slide member comprising a pivot pin mounted on one end of said rod, said pivot pin engaging a slot in said drive member.

21. A shuttleless loom as claimed in claim 12, said weft carrier being driven at maximum speed when the connection between said rod and said drive member is at its nearest position to the pivot axis of said drive member to said frame, and said weft carrier moving at its minimum speed when the connection between said rod and said drive member is at its furthest distance from the pivot axis of said drive member to said frame.

22. A shuttleless loom as claimed in claim 12, said drive mechanism comprising a handle connected to said guide member, the position of said guide member relative to said drive member being alterable by an operator through use of said handle.

23. A shuttleless loom comprising a frame, at least one weft carrier supported on said frame, and a drive mechanism supported by said frame to drive said weft carrier, said drive mechanism comprising a rod, means connected to said rod at its driven end to drive said rod in a reciprocating path, a drive member connected to said weft carrier, said drive member being pivotally connected to said frame, and said drive member being pivotally connected to said rod at said rod's non-driven end, and a guide member fixed in position relative to said frame, said guide member being connected to both said rod and said drive member, said rod and drive member being movable relative to said immobile guide member and relative to one another during each loom cycle, and said guide member functioning to vary that distance between the pivot connection of said rod to said drive member and the pivot axis of said drive member relative to said frame during each loom cycle, the speed of the drive transmitted by said drive mechanism to said weft carrier thereby being varied also in response to the variation of said distance.

24. A shuttleless loom as claimed in claim 23, said drive mechanism further comprising adjustment means connected to said guide member, said adjustment means permitting said guide member to be adjustably positioned in a desired fixed location relative to said frame.

25. A shuttleless loom as claimed in claim 23, said drive mechanism comprising a flexible perforated tape connecting said drive mechanism to said weft carrier, the perforations of said tape meshing with the teeth of a drive wheel driven by a drive shaft.

26. A shuttleless loom as claimed in claim 25, said drive mechanism comprising a pinion driven by an arcuate strip mounted on said drive member.

27. A shuttleless loom as claimed in claim 26, said drive member having the general shape of a quadrant of a circle.

28. A shuttleless loom as claimed in claim 23, said connecting rod engaging both said drive member and said guide member, and a crank member acting through said connecting rod.

29. A shuttleless loom as claimed in claim 23, said connecting rod comprising a pivot pin mounted on one end thereof, said pivot pin engaging a guide path defined by said guide member.

30. A shuttleless loom as claimed in claim 23, where said guide member comprises a plate with a guide slot therein.

31. A shuttleless loom as claimed in claim 30, the position of said slot in said guide member being adjustable relative to the position of the pivot of said drive member to said frame.

32. A shuttleless loom as claimed in claim 23, said weft carrier being driven at maximum speed when the connection between said rod and said drive member is at its nearest position to the pivot axis of said drive member to said frame, and said weft carrier moving at minimum speed when the connection between said rod and said drive member is at its furthest distance from the pivot axis of said drive member to said frame.

33. A shuttleless loom as claimed in claim 23, said drive mechanism comprising a handle connected to said guide member, the position of said guide member relative to said drive member being alterable by an operator through use of said handle.

34. A drive mechanism to drive a weft carrier of a shuttleless loom, said drive mechanism comprising a connecting rod and a frame, means connected to said rod at its driven end to drive said rod in a reciprocating path, a drive member connectable to said weft carrier, said drive member being pivotally connected to said frame, and said drive member being pivotally connected to said rod at said rod's non-driven end to pivot said drive member during reciprocation of said rod, and a guide member which defines a guide path, said guide member being slidably connected to said rod at said rod's non-driven end so that said slidable connection follows said guide path during reciprocation of said rod, said rod, drive member and guide member all being movable relative one to another during each loom cycle, and said guide member functioning to vary that distance between the pivot connection of said rod to said drive member and the pivot axis of said drive member relative to said frame during each loom cycle, the speed of the drive transmitted by said drive mechanism to said weft carrier being varied also in response to the variation in said distance.

35. A drive mechanism as claimed in claim 34, said drive mechanism further comprising adjustment means connected to said guide member, said adjustment means permitting said guide member to be adjustably positioned in a desired fixed location relative to said frame.

36. A drive mechanism as claimed in claim 34, said drive mechanism comprising a flexible perforated tape connecting said drive member to said weft carrier, the perforations of said tape meshing with the teeth of a drive wheel driven by a drive shaft, and a pinion driven by an arcuate strip mounted on said drive member.

37. A drive mechanism as claimed in claim 34, said connecting rod engaging both said drive member and said guide member, and said connecting rod comprising a pivot pin mounted on one end thereof, said pivot pin engaging said guide path in said guide member.

38. A drive mechanism as claimed in claim 34, the position of said guide path in said guide member being adjustable relative to the position of the pivot of said drive member to said frame.

39. A drive mechanism as claimed in claim 34, said weft carrier being drivable at maximum speed when the connection between said rod and said drive member is at its nearest position to the pivot axis of said drive member to said frame, and said weft carrier being movable at minimum speed when the connection between said rod and said drive member is at its furthest distance from the pivot axis of said drive member to said frame.

40. A drive mechanism to drive a weft carrier of a shuttleless loom, said drive mechanism comprising a frame, a connecting rod having a slide member attached to one end thereof, means connected to said rod to drive said rod in a reciprocating path, a drive member pivotally connected to both said frame and said rod, said drive member also being connectable to said weft carrier, and a guide member comprising a pair of generally parallel edges which cooperate to define a guide slot, said rod's slide member being engaged with said guide slot to connect said rod and said guide member, said guide member also being connected to said drive member, said rod, drive member and guide member all being movable relative one to another during each loom cycle, and said guide member functioning to vary that distance between the pivot connection of said rod to said drive member and the pivot axis of said drive member relative to said frame during each loom cycle, the speed of the drive transmitted by said drive mechanism to said weft carrier being varied also in response to the variation in said distance.

41. A drive mechanism as claimed in claim 40, said drive mechanism further comprising adjustment means connected to said guide member, said adjustment means permitting said guide member to be adjustably positioned in a desired fixed location relative to said frame.

42. A drive mechanism as claimed in claim 40, said drive mechanism comprising a flexible perforated tape connecting said drive member to said weft carrier, the perforations of said tape meshing with the teeth of a drive wheel drive by a drive shaft, and a pinion driven by an arcuate strip mounted on said drive member.

43. A drive mechanism as claimed in claim 40, said connecting rod engaging both said drive member and said guide member, and said connecting rod comprising a pivot pin mounted on one end thereof, said pivot pin engaging a slot defined by said guide member.

44. A drive mechanism as claimed in claim 40, the position of said slot in said guide member being adjustable relative to the position of the pivot of said drive member to said frame.

45. A drive mechanism as claimed in claim 40, said weft carrier being drivable at maximum speed when the connection between said rod and said drive member is at its nearest position to the pivot axis of said drive member to said frame, and said weft carrier being movable at its minimum speed when the connection between said rod and said drive member is at its furthest distance from the pivot axis of said drive member to said frame.

46. A drive mechanism to drive a weft carrier of a shuttleless loom, said drive mechanism comprising a rod and a frame, means connected to said rod at its driven end to drive said rod in a reciprocating path, a drive member connectable to said weft carrier, said drive member being pivotally connected to said frame, and said drive member being pivotally connected to said rod at said rod's non-driven end, and a guide member fixed in position relative to said frame, said guide member being connected to both said rod and said drive member, said rod and drive member being movable relative to said immobile guide member and relative to one another during each loom cycle, and said guide member functioning to vary that distance between the pivot connection of said rod to said drive member and the pivot axis of said drive member relative to said frame during each loom cycle, the speed of the drive transmitted by said drive mechanism to said weft carrier thereby being varied also in response to the variation of said distance.

47. A drive mechanism as claimed in claim 46, said drive mechanism further comprising adjustment means connected to said guide member, said adjustment means permitting said guide member to be adjustably positioned in a desired fixed location relative to said frame.

48. A drive mechanism as claimed in claim 46, said drive mechanism comprising a flexible perforated tape connecting said drive mechanism to said weft carrier, the perforations of said tape meshing with the teeth of a drive wheel driven by a drive shaft, and a pinion driven by an arcuate strip mounted on said drive member.

49. A drive mechanism as claimed in claim 46, said connecting rod engaging both said drive member and said guide member, and said connecting rod comprising a pivot pin mounted on one end thereof, said pivot pin engaging a guide path defined by said guide member.

50. A drive mechanism as claimed in claim 46, said guide member comprising structure defining a guide slot therein, the position of said slot in said guide member being adjustable relative to the position of the pivot of said drive member to said frame.

51. A drive mechanism as claimed in claim 46, said weft carrier being drivable at maximum speed when the connection between said rod and said drive member is at its nearest position to the pivot axis of said drive member to said frame, and said weft carrier being movable at minimum speed when the connection between said rod and said drive member is at its furthest distance from the pivot axis of said drive member to said frame.

* * * * *